United States Patent [19]

Posey

[11] 4,044,469

[45] Aug. 30, 1977

[54] MULTI-FUNCTION MEASURING INSTRUMENT

[76] Inventor: Donald L. Posey, 1418 N. King St., Hampton, Va. 23669

[21] Appl. No.: 726,715

[22] Filed: Sept. 24, 1976

Related U.S. Application Data

[63] Continuation of Ser. No. 606,892, Aug. 22, 1975, abandoned, which is a continuation-in-part of Ser. No. 475,339, May 31, 1974, abandoned.

[51] Int. Cl.[2] ..... B43L 7/06

[52] U.S. Cl. ..... 33/102; 33/138; 33/94

[58] Field of Search ..... 33/DIG. 1, 1 LE, 75 R, 33/93, 94, 92, 97, 102, 138, 347

[56] References Cited

U.S. PATENT DOCUMENTS

| | | | |
|---|---|---|---|
| 236,469 | 1/1881 | Walters | 33/94 |
| 823,444 | 6/1906 | Sassaman | 33/102 |
| 1,983,516 | 12/1934 | Ahola | 33/94 |
| 2,352,169 | 6/1944 | Alexander | 33/75 R |
| 2,517,264 | 8/1950 | Wake | 33/94 |
| 3,036,791 | 5/1962 | Siggelkow | 33/347 X |
| 3,095,651 | 7/1963 | Luedicke | 33/138 X |
| 3,225,451 | 12/1965 | Olexson et al. | 33/347 |
| 3,269,015 | 8/1966 | Barker | 33/138 X |

*Primary Examiner*—Charles E. Phillips
*Attorney, Agent, or Firm*—Howard J. Osborn; Wallace J. Nelson; John R. Manning

[57] ABSTRACT

An adjustable geometrical instrument for making interrelated angular and linear measurements comprising an alinement head, a detachably mounted retractable tape measure, and a slidably mounted cooperating angle indicator. Indices of linear measurement are provided on the alinement head for determining the distance between the tape measure and the vertex of the angle being formed by the angle indicator and the alinement head, thus providing for calculation of the total linear distance between a reference point and the desired point of angular measurement. Provision is made for mounting the tape measure at either end of the alinement head in alinement therewith by means of a permanent magnet recessed in the bottom of the tape measure unit and alinement pins which cooperate with corresponding mounting recesses in the alinement head.

6 Claims, 3 Drawing Figures

MULTI-FUNCTION MEASURING INSTRUMENT

ORIGIN OF THE INVENTION

The invention described herein was made by an employee of the United Government and may be manufactured and used by or for the Government for governmental purposes without the payment of any royalties thereon or therefor.

This application is a continuation of application Ser. No. 606,892, filed Aug. 22, 1975, which was a continuation-in-part of Ser. No. 475,339, filed May 31, 1974, both now abandoned.

BACKGROUND OF THE INVENTION

1. Field of the Invention

This invention generally relates to geometrical instruments and, more particularly, to adjustable instruments for making combined linear and angular measurements.

2. Description of the Prior Art

A number of adjustable layout tools have been developed which allow varying degrees of flexibility in making combined linear and angular measurements. For purposes of illustration, patents representative of such devices include U.S. Pat. No. 652,814 (Setzer); U.S. Pat. No. 2,435,529 (Brockley); U.S. Pat. No. 2,571,569 (Greenwood); U.S. Pat. No. 2,822,834 (Hammers); and U.S. Pat. No. 3,269,015 (Barket); although this listing is not represented to be, nor intended to be, in any way exhaustive. A number of layout tools have also been developed in which several components have been detachably joined, thus allowing use of the components separately as individual tools. Although the prior art devices do provide for relating a linear measurement to an angular measurement, the utility of even the most versatile devices is limited by disadvantages which restrict the range of combined measurements that can be made conveniently. For example, The Barker instrument referred to above, for example, in which two tape measures are mounted on the ends of two arms which are rotatably joined at their other ends permits linear and angular measurements from a vertex which is located at the intersection point of the center lines of the arms provided that the angular measurements do not fall within the area of overlap of the two arms.

SUMMARY OF THE INVENTION

The limitations and disadvantages of the prior art are overcome to substantial extent by the geometrical instrument of the invention. The instrument of the present invention basically comprises an alinement head, an angular measurement device or angle indicator slidably mounted on the alinement head and a tape measure detachably mounted on the alinement head, whereby linear measurements made with the tape measure can be integrated with angular measurements made with the angle indicator.

According to a preferred embodiment, the alinement head comprises a rectilinear central bar, one edge of which serves as a measuring edge for alining the instrument with the item to be measured and for indicating the distance of the angle indicator from the ends of the alinement head. Indices of linear measurement are located on the upper surface of the central bar adjacent to the measuring edge in order to provide a ready indication of the distance to either end of the alinement head. The alinement head further comprises mounting plates located on the upper surface of the central bar at each end thereof for supporting the detachable tape measure such that the end of the tape unit from which the tape extends is flush with the end of the central bar being used, thereby making the edge of the tape colinear with the measuring edge of the central bar.

The angle indicator preferably comprises a flat angular indication plate on which is located indices of angular measurement. A straight-edged swing arm is rotatably mounted on the indication plate such that the arm, in cooperation with the measurement indices, indicates the angle of intersection of a selected one of the longitudinal edges of the swing arm with the measuring edge of the central bar. The angular indicator is slidably mounted on the alinement head by means of a longitudinal slot in the central bar. In using the invention, the angular indicator is slidably adjusted on the alinement head so that the point of interception of the swing arm with the measuring edge, when the swing arm is adjusted to the desired angle, coincides with one of the indices of linear measurement, thus facilitating use of the tape measure to locate the angle of intersection at the desired point on the item to be measured.

Other features and advantages of the invention will be set forth in, or apparent from, the detailed description of the invention found hereinbelow.

DESCRIPTION OF THE PREFERRED EMBODIMENTS

Figure 1:
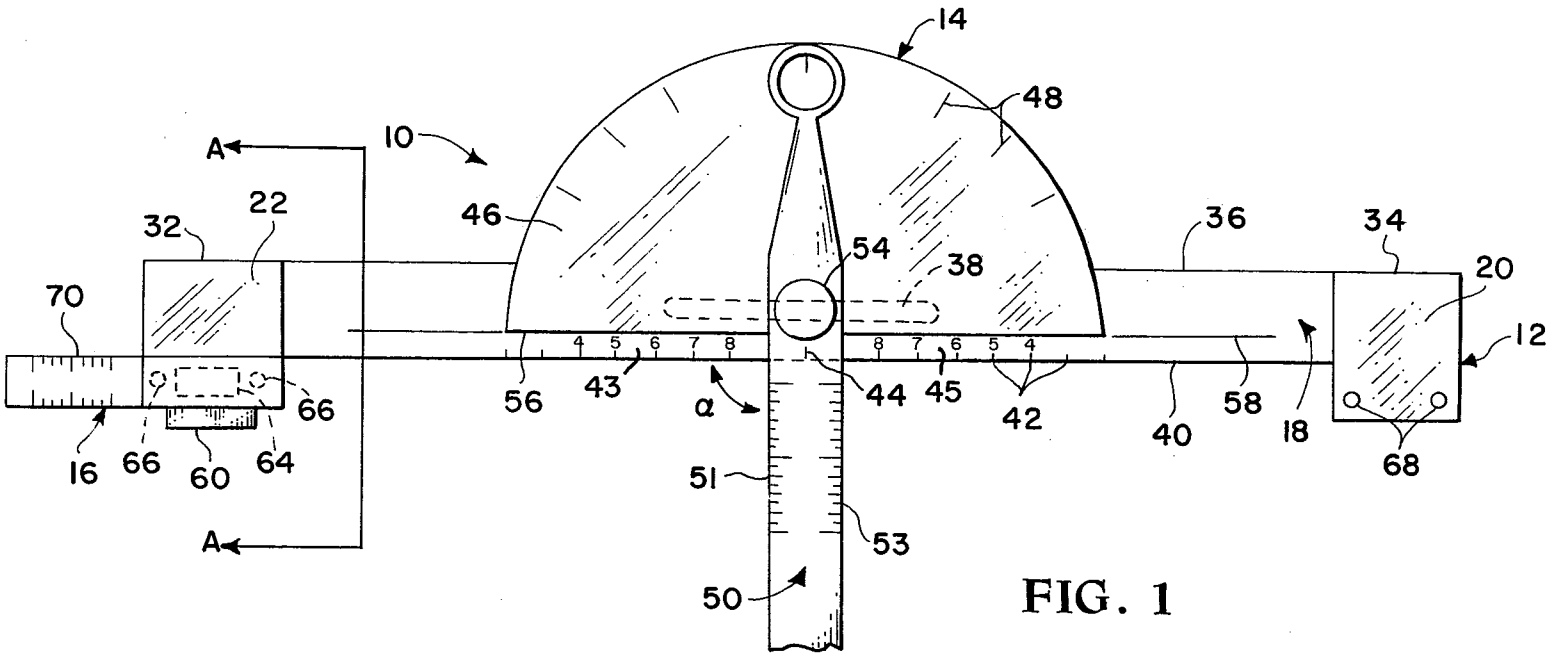
FIG. 1 is a plan view, partially in section, of a preferred embodiment of the invention.

Referring to the figures, the adjustable measuring tool of the invention, which is generally denoted 10, will now be described. The preferred embodiment illustrates how the measuring tool 10 is used to simultaneously measure linear distances and angles on a workpiece 11 having a first surface 13 and a second surface 15 which intersect.

Figure 2:
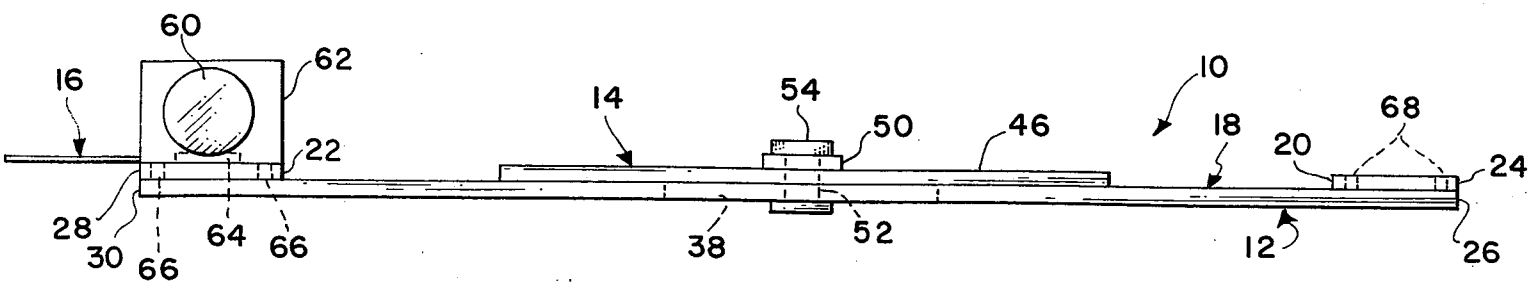
FIG. 2 is a bottom view, partially in section, of the embodiment of FIG. 1.
Figure 3:
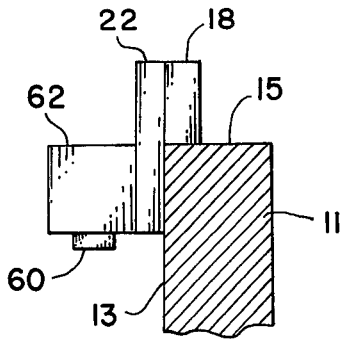
FIG. 3 is a section view of the embodiment of FIG. 1 along section A—A.

The measuring instrument or tool 10 comprises a metallic alinement head assembly which is generally denoted 12 and on which is slidably mounted a protractor-type angle measuring device or angle indicator generally denoted 14. In addition, an adjustable tape measure unit 16 is detachably mounted on alinement head assembly 12. Alinement head 12 comprises a rectilinear, straight-edged bar 18, to which is attached on the upper surface at the two ends thereof, first and second identical rectilinear mounting plates 20 and 22. Plates 20 and 22 are oriented with respect to bar 18 such that their length dimensions, which are relatively greater than the width dimension of bar 18, are parallel to the width dimension of bar 18 and thereby overlap onto surface 13 of workpiece 11. The right edge 24 of plate 20 is flush with the right edge 26 (see FIG. 2) of bar 18 and the left edge 28 of plate 22 is flush with the left edge 30 (see FIG. 2) of bar 18. As illustrated, the top edges 32 and 34 of plates 20 and 22 respectively, are flush with the top edge 36 of bar 18. Located in the center of bar 18 is a longitudinal slot 38. Ruled in the top surface of bar 18 along a measurement edge 40 are a series of spaced indicia 42 for linear measurement. The indicia 42 form two scales 43 and 45 and are designated by numerals as illustrated such that the indicia to the left of a center index mark 44 represent the distance each is from edge 30 of bar 18 and the indicia to the right of center index mark 44 represent the distance each is from edge 26 of bar 18.

Angle indicator 14 comprises an angular measurement or indication plate 46, in the top surface of which are ruled spaced indicia 48 of angular measurement. Angle indicator 14 further comprises a swing arm 50 which is rotatably mounted on plate 46 by means of a threaded bolt 52, which extends through slot in bar 18 through plate 46, and is secured by a locking nut 54. Swing arm 50 is so designed that it simultaneously provides a straight edge and, in cooperation with indicia 48, an indication of the angle of intersection $\alpha$ between measurement edge 40 of bar 18 and a selected one of edges 51 and 53 of swing arm 50. The same bolt 52 which is used to rotatably mount arm 50 to plate 46 is also inserted through slot 38 of bar 18, thereby allowing sliding of the angle indicator assembly 14 along the alinement head 12. With the above described mounting arrangement, when the position of angle indicator 14 is slidably adjusted on alinement head 12, indication plate 46 is free to rotate with respect to alinement head 12. In the preferred embodiment the indication plate 46 is alined with alinement line 58 on bar 18. However, in other embodiments indication plate 46 may be mounted to bar 18 in a slidable but non-rotatable position.

Tape measure unit 16 can advantageously employ any conventional retractable tape measure modified as described below. In a preferred embodiment the tape measure 16 includes an eccentric cam-locking device (not shown), the control knob of which is indicated at 60, which allows locking the tape of tape measure 16 at any desired setting. In order to provide detachable mounting, the case or body 62 is modified by the addition of a magnet 64 located in a recess in the bottom face of case 62 so as to be flush with the bottom of case 62, and the addition of two conventionally detachable alining pins 66 which protrude from either end of the bottom face of case 62. Corresponding mounting recesses or holes 68 are provided in mounting plates 20 and 22 for receiving the alining pins 66 of tape measure 16 and are positioned so as to ensure that the edge 70 of the tape of tape measure 16 is alined in coplanar relation with edge 40 of bar 18, and that the end of the housing unit 62 is flush with the edge 26 or 30 of bar 18. The magnet 64 effectively secures the tape measure 16 to the alinement head 10, while allowing ready removal, and the alining pins 66 serve to absorb any shear load induced by tensioning the tape and to ensure correct positioning of the tape measure 16 on the alinement head 12.

OPERATION

In utilizing the measuring instrument 10, the alinement head 12 is positioned on the workpiece 11 by placing plates 20 and 22 in flush engagement with surface 13 while simultaneously alining measurement edge 40 of bar 18 in flush engagement with surface 15 of workpiece 11. The locking nut 54 being loosened, the desired angle of intersection $\alpha$ between a selected one of edges 51, 53 of swing arm 50 and edge 40 of bar 18 is determined by adjusting swing arm 50 to the requisite angle. It will be appreciated that whether angle $\alpha$ is defined by edge 51 or 53 is determined by whether tape measure 16 is mounted on plate 20 or 22. At the same time, the angle indication plate 46 is slidably adjusted such that the selected edge 51 or 53 of arm 50, when adjusted for the desired angle, just intersects one of the linear indicia 42. Locking nut 54 is then tightened taking care to ensure that the bottom edge 56 of plate 46 is alined with line 58. The angle indicator 14 is thus locked and ready for use. The desired linear measurement is obtained by adjusting the tape measure 16 to a length equal to the desired length minus the length indicated by the indica 42 which intersects the edge of swing arm 50. When tape measure 16 is so set, the distance between the end of the extended tape of tape measure 16 and the vertex of the $\alpha$ formed by the intersection of the edge 51 or 53 of arm 50 with edge 40 of bar 18 will be the desired length. Since tape measure 16 may be mounted on either plate 20 or 22 and since either edge 51 or 53 of the swing arm 50 may be used to form the desired angle $\alpha$, and further since two linear scales are provided combined angular and linear measurements may be made utilizing either end of instrument 10 as convenience dictates.

In alternative embodiments of the invention the tape measure unit 16 may be detachably mounted on other geometric instruments which have been modified by the addition of appropriate recesses, similar to recesses 68, designed to receive the alining pins 66 of tape measure 16. Specific examples of geometric instruments contemplated include tee squares and forming angles. The detachable feature of alining pins 66 also allows tape measure 16 to be used by itself in a conventional manner.

It will be understood by those skilled in the art that the invention has been described with reference to an exemplary embodiment and that variations and modifications can be effected in this embodiment without departing from the scope and spirit of the invention.

What is claimed as new and desired to be secured by Letters Patent of the United States is:

1. A geometrical instrument for simultaneously measuring linear distance and angles comprising:

an elongated bar having two ends and an indicia means for making linear measurements;

a first mounting plate fastened to one of said ends and a second mounting plate fastened to said other end;

an adjustable tape measure having means for detachment and reattachment of said same tape measure to said instrument; said tape measure being selectively detachable from one of said first or second mounting plates and reattachable to the other of said first or second plates, said first and second mounting plates positioning said tape measure thereon; said tape measure cooperating with said indicia means to indicate the distance from a distant point from either end of said bar to any indicia point along said elongated bar;

an adjustable angle measuring device slidably mounted on said elongated bar for enabling measurements to be made of an angle and of the distance from the vertex of that angle to a distant point, concurrently and in combination; wherein said elongated bar has a slot therein in which said angle measuring device is slidably mounted and a measurement edge means on said elongated bar said measurement edge means for alining said instrument with a workpiece and being positionable on a first surface of the workpiece and said first and second mounting plates being oriented with respect to said elongated bar such as to extend below said measurement edge means to provide an angled recess for engagement of an angled corner of a workpiece.

2. The geometrical instrument of claim 1 wherein said angle measuring device comprises an angle indication plate having upper and lower surfaces, indices of angular measurement located on said upper surface of said indication plate, and a straight-edged swing arm means for indicating, in cooperation with said indices of angular measurement, the angle of intersection between either longitudinal edge of said swing arm and said measurement edge means of said elongated bar; said swing arm means being rotatably mounted on said angle indication plate and being positionable over the second surface of the workpiece.

3. The geometrical instrument of claim 2 further comprising alinement means for ensuring the proper alinement of said angle measuring device with respect to said measuring edge.

4. The geometrical instrument of claim 3 wherein said alinement means comprises an alinement line located on said elongated bar parallel to said measurement edge means and a cooperating straight bottom edge on said angle indication plate allowing said plate to be alined parallel to said measurement edge means.

5. The geometrical instrument of claim 2 wherein said angle measuring device is non-rotatable with respect to said measurement edge means.

6. The geometrical instrument of claim 2 wherein said elongate bar further comprises an indicia means located on said measurement edge means for indicating the distance of said angle of intersection of said swing arm means with said measurement edge means selectively from either of said ends of said elongated bar; said indicia means having a first scale of linear measurement beginning with a zero indication at one of said ends of said elongated bar and a second scale of linear measurement beginning with a zero indication at said other end; said first and second scales having linear measurement indications increasing toward a point midway between said ends of said elongated bar; said indicia means enabling the determination of the total distance from the end of the tape measurement to said angle of intersection with said tape measure mounted on either of said ends of said elongated bar and with said angle of intersection at any point along said elongated bar.

* * * * *